US010435885B2

(12) United States Patent
Piethman

(10) Patent No.: US 10,435,885 B2
(45) Date of Patent: Oct. 8, 2019

(54) MODULAR WALL SYSTEM

(71) Applicant: Kevin Piethman, Orange, CA (US)

(72) Inventor: Kevin Piethman, Orange, CA (US)

( * ) Notice: Subject to any disclaimer, the term of this patent is extended or adjusted under 35 U.S.C. 154(b) by 0 days.

(21) Appl. No.: 16/055,035

(22) Filed: Aug. 4, 2018

(65) Prior Publication Data

US 2019/0040630 A1 Feb. 7, 2019

Related U.S. Application Data

(60) Provisional application No. 62/541,302, filed on Aug. 4, 2017.

(51) Int. Cl.

| | |
|---|---|
| ***E04B 2/74*** | (2006.01) |
| ***E04B 1/14*** | (2006.01) |
| ***E04B 2/00*** | (2006.01) |
| ***E04C 2/52*** | (2006.01) |

(52) U.S. Cl.

CPC ..... *E04B 2/7425* (2013.01); *E04B 1/14* (2013.01); *E04C 2/46* (2013.01); *E04C 2/521* (2013.01); *E04B 2002/7462* (2013.01); *E04B 2002/7488* (2013.01)

(58) Field of Classification Search

CPC .. E04B 2/7425; E04B 1/14; E04B 2002/7488; E04B 2002/7462; E04C 2/521; E04C 2/46

See application file for complete search history.

(56) References Cited

U.S. PATENT DOCUMENTS

| | | | | |
|---|---|---|---|---|
| 4,535,577 | A * | 8/1985 | Tenser | E04B 2/7429 174/495 |
| 6,389,773 | B1 * | 5/2002 | Reuter | E04B 2/7425 160/135 |
| 7,484,705 | B2 * | 2/2009 | Hand | E04B 2/7422 248/519 |
| 9,428,901 | B2 * | 8/2016 | Price | E04B 1/34315 |
| 9,963,877 | B2 * | 5/2018 | Hall | E04H 1/005 |
| 10,287,770 | B2 * | 5/2019 | Hodson | E04B 1/34321 |
| 2011/0107696 | A1 * | 5/2011 | Preiss | E04B 2/7422 52/238.1 |
| 2015/0101263 | A1 * | 4/2015 | Price | E04B 1/34315 52/79.1 |
| 2015/0135605 | A1 * | 5/2015 | Price | E04B 1/34315 52/79.9 |
| 2016/0168863 | A1 * | 6/2016 | Kwan | E04F 13/0805 52/36.5 |
| 2017/0121961 | A1 * | 5/2017 | Hodson | E04B 1/34321 |
| 2017/0335562 | A1 * | 11/2017 | Hall | E04H 1/005 |

FOREIGN PATENT DOCUMENTS

| | | | | |
|---|---|---|---|---|
| FR | 2977616 | A1 * | 1/2013 | E04B 2/7425 |
| FR | 2977618 | A1 * | 1/2013 | E04B 2/7425 |

* cited by examiner

*Primary Examiner* — Rodney Mintz
(74) *Attorney, Agent, or Firm* — Bruce A. Lev

(57) ABSTRACT

A modular wall system is an easily assembled or disassembled wall or partition having connectable block sections that connect together on any side edge to form a wall. The side edges have slotted openings for conduit or wiring to pass through, and contact brackets that are linearly adjustable in length attach to the top, side, or bottom of the formed wall to fill in the space and attach to an existing wall, ceiling, or floor. The block sections have panels that cover the open spaces on front and back once erected.

14 Claims, 7 Drawing Sheets

MODULAR WALL SYSTEM

CROSS-REFERENCE TO RELATED APPLICATION

The present application is related to and claims priority from prior provisional application Ser. No. 62/541,302, filed Aug. 4, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of wall construction devices and more specifically relates to a modular wall system.

2. Description of the Related Art

In many homes, apartments, condominiums and other living environments there is not a suitable way to divide rooms or construct a wall without hiring a contractor to do the work. Going to the local hardware store to buy wood, drywall, joint compound and various other tools in which to install a wall can be expensive, especially when the arrangement may not be permanent and a future situation may require the removal of the wall. In suburban living, families often have more than one child in a bedroom because homes are nearly always purchased based on the ability to pay the mortgage, not necessarily on the size needed. Because of this, sometimes rooms need to be divided in some manner to create more private space for children. Sometimes the partitions can be mid-height walls and sometimes full height walls are needed to create different rooms but in the long term, larger rooms may be needed.

When constructing larger projects such as buildings, certain procedures must be followed. For instance, the foundation and floors must be constructed before constructing the walls. The walls must be completed before installing the trusses and roofing. Each phase must be performed in the proper sequence and the scheduled overall completion of the project can sometimes be delayed considerably. Each phase requires different disciplines and brings into the project materials from different manufacturers. This requires knowledgeable management and even then control can get lost because of lack of material availability and shipping delays of the various companies involved. A building system is needed that allows the different phases to be constructed simultaneously to avoid delays and can be accomplished by anyone without professional carpentry experience.

Ideally, a building system should provide modular construction and reduced construction time, yet, would operate reliably and be manufactured at a modest expense. Thus, a need exists for a reliable modular wall system to avoid the above-mentioned problems.

BRIEF SUMMARY OF THE INVENTION

In view of the foregoing disadvantages inherent in the known wall construction device art, the present invention provides a novel modular wall system. The general purpose of the present invention, which will be described subsequently in greater detail, is to provide modular construction and reduced construction time.

A modular wall system preferably comprises a plurality of block members with each one including four side wall components, a first surface, a second surface opposite from the first surface, and two spaced elongated end edge portions. Each elongated end edge portion includes a hinge portion and two spaced elongated side edge portions and each elongated side edge portion includes an elongated slot.

The four side wall components are pivotally connected to one another via the hinge portions of respective adjacent elongated end edge portions such that they are adapted to form a rectangular configuration when in use and a flat configuration when in storage. The plurality of block members are adapted to be stacked one on top of the other and placed side-by-side to form a modular wall.

A plurality of securing clips each including a first elongated side edge including a connector member thereon and are adapted to releasably connect with the slots of the elongated side edge portions of the four side wall components of any of the plurality of block members. A second elongated side edge includes a connector member thereon and is adapted to releasably connect with the slots of the elongated side edge portions of the four side wall components of any of the plurality of block members. The second elongated side edge is spaced from the first elongated side edge. The securing clips are adapted to releasably connect adjacent the plurality of block members.

At least one tensioning bracket that includes at least one connector portion is adapted to releasably connect to the two spaced elongated side edge portions of any one of the four side wall components of any one of the plurality of block members. An extension portion having an adjustment section includes a series of spaced connector members that is adapted to releasably connect with the connector portion via the series of spaced connector members such that the tensioning bracket(s) is/are linearly adjustable. A contact panel is connected to the adjustment section and is adapted to contact a wall or ceiling member. When in use, the tensioning bracket is adapted to act as a support and create space and tension between the modular wall system and a wall and ceiling and to stabilize the modular wall system.

A plurality of exterior panel members are adapted to releasably connect with respective securing clips such that they can be used to cover a selected portion of the modular wall system. Each of the four side wall components include an opening therethrough adapted to allow cables and conduit to pass through. The securing clips are formed having a linear shape adapted to releasably connect with two linearly adjacent side wall components. Securing clips for use on corners are formed having an L-shape and are adapted to releasably connect with two perpendicularly adjacent side wall components. Securing clips for use in T-joints or for joining sections are formed having a T-shape and are adapted to releasably connect with three adjacent side wall components. The securing clips are formed having an X-shape and is adapted to releasably connect with four adjacent side wall components.

Each securing clip includes a magnetic outer surface thereon and the exterior panel members include magnetic edge portions adapted to releasably connect with the magnetic outer surfaces of the securing clips such that the exterior panel members are adapted to be releasably connected to any one of the block members. The block members are formed from a material chosen from a list of materials consisting of plastic and metal. The exterior panel members are formed from a material chosen from a list of materials consisting of plastic and metal.

At least two floor base connectors are each adapted to fit within respective openings of the side wall components and releasably connect thereto, and are adapted to releasably attach to a floor such that the floor base connectors help stabilize the modular wall system to the floor. Each of the floor base connectors include a double-sided key adapted to releasably connect with the floor. The floor base connectors may include a bristle attachment adapted to releasably connect with a carpet upon the floor. A plurality of interior plate members are each adapted to cover the opening of any one of the side wall components of the block members. The rectangular configuration of the block members has a square cross-section.

The indexing and alignment of each block member(s) is made simple when stacking each of the block member(s). A round indexing peg protruding outward and a matching divot recessed inward is located at each end of each side wall component allows the user to perfectly align the block member(s) and prevent any sliding when stacked vertically or horizontally. Round indexing pegs of one block member(s) will snap into the matching divots of an adjacent block member(s). This ensures the alignment both vertically and horizontally with the previous block member(s) during construction.

The present invention holds significant improvements and serves as a modular wall system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, modular wall system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a wall construction device and more particularly to a modular wall system as used to reduced construction time and labor with modular construction.

Generally speaking, a modular wall system is an easily assembled or disassembled wall or partition having connectable block sections that connect together on any side edge to form a wall. The side edges have slotted openings for conduit or wiring to pass through, and contact brackets that are linearly adjustable in length attach to the top, side, or bottom of the formed wall to fill in the space and attach to an existing wall, ceiling, or floor. The Block sections have panels that cover the open spaces on front and back once erected.

Figure 1:
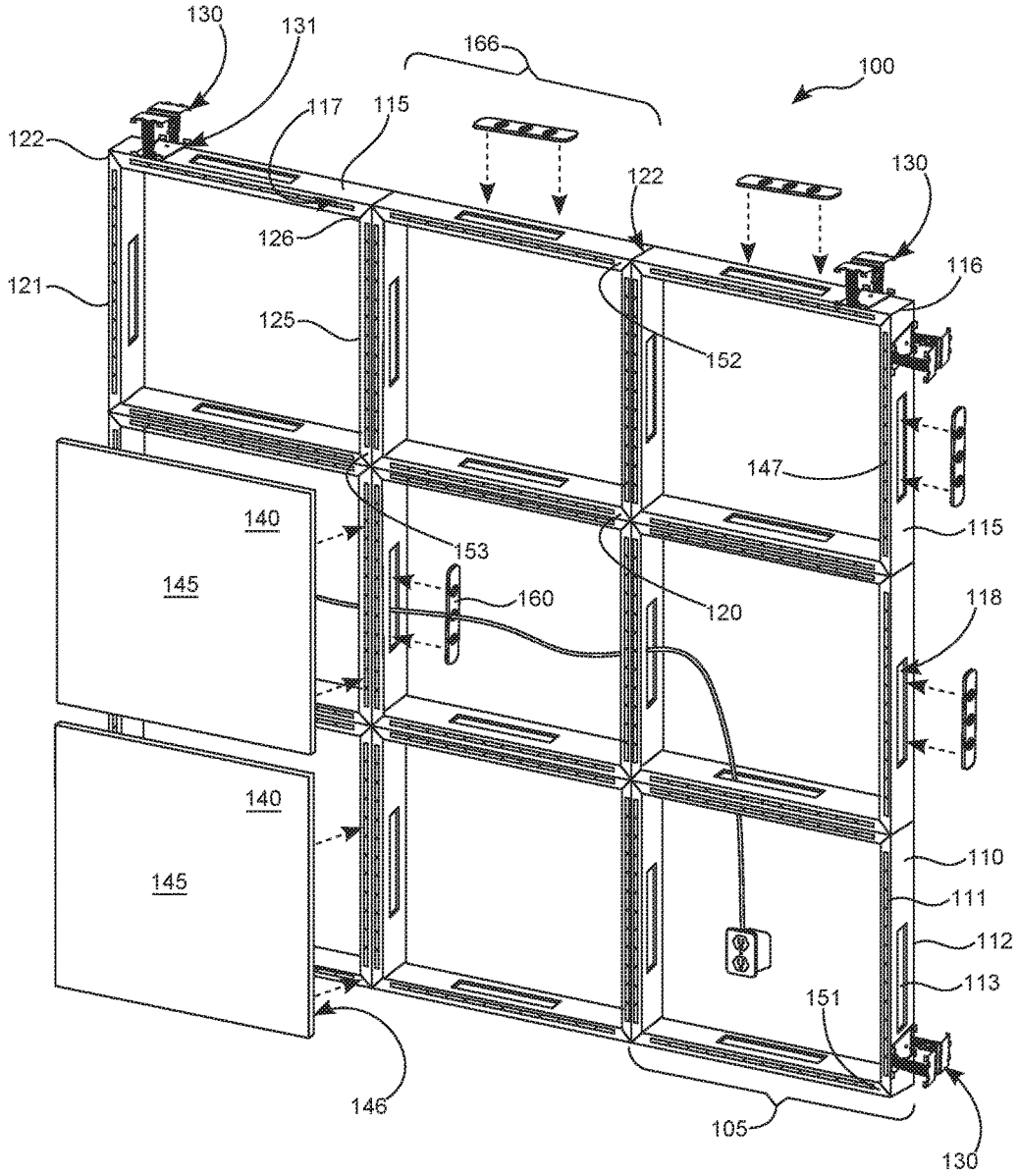
FIG. 1 shows a perspective view illustrating a modular wall system according to an embodiment of the present invention.

Referring to the drawings by numerals of reference there is shown in FIG. 1, a perspective view illustrating modular wall system 100 according to an embodiment of the present invention.

Modular wall system 100 preferably comprises a plurality of block members 105 with each one including four side wall component 110, first surface 111, second surface 112 opposite from first surface 111, and two spaced elongated end edge portions 115. Each elongated end edge portions 115 includes hinge portion 116 and two spaced elongated side edge portions 117 and each elongated side edge portion 117 includes an elongated slot 118.

Figure 2:
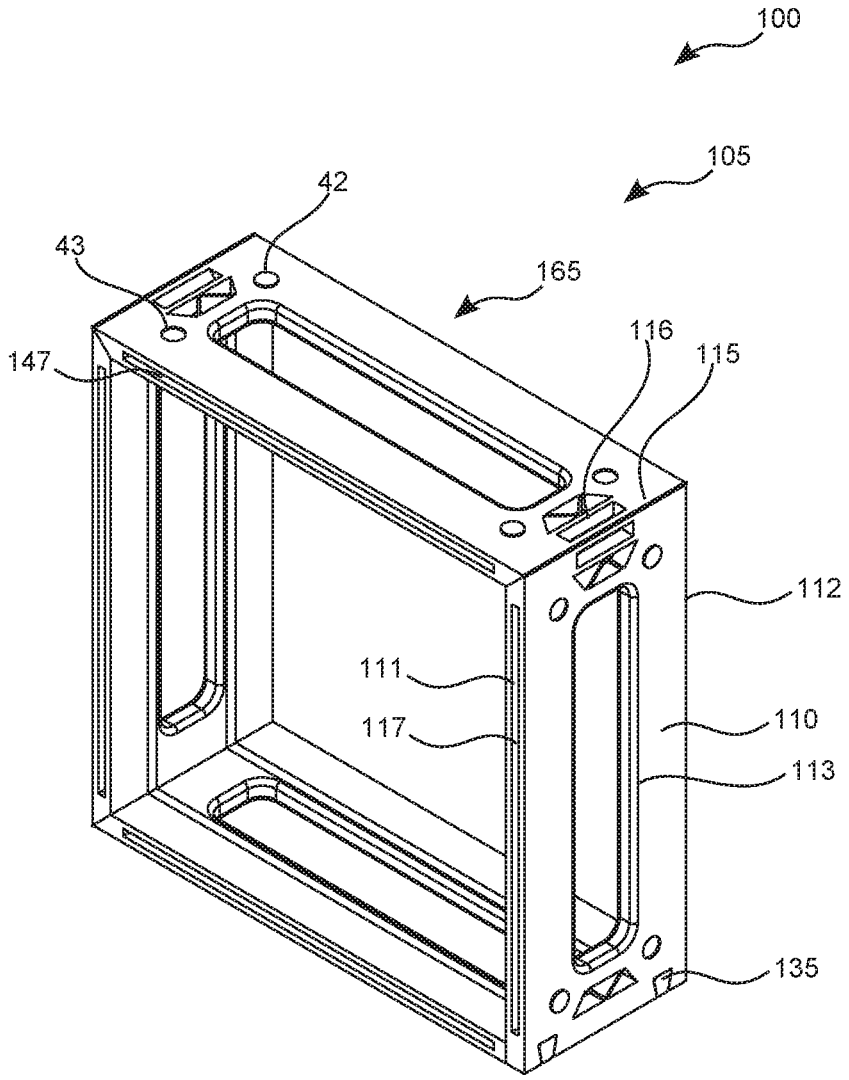
FIG. 2 is a perspective view illustrating block members of the modular wall system according to an embodiment of the present invention of FIG. 1.

Referring now to FIG. 2, is a perspective view illustrating block members of modular wall system 100 according to an embodiment of the present invention of FIG. 1.

The four side wall components 110 are pivotally connected to one another via hinge portions 116 of respective adjacent elongated end edge portions 115 such that they are adapted to form a rectangular configuration when in use and a flat configuration when in storage. The plurality of block member(s) 105 are adapted to be stacked one on top of the other and placed side-by-side to form modular wall system 100. Block member(s) 105 are formed from a material chosen from a list of materials consisting of plastic and metal. The rectangular 165 configuration of block member(s) 105 has square cross-section 166.

The indexing and alignment of each block member(s) 105 is made simple when stacking each of block member(s) 105. A round indexing peg 42 protruding outward and a matching divot recessed inward is located at each end of each side wall component 110 allows the user to perfectly align block member(s) 105 and prevent any sliding when stacked vertically or horizontally. Round indexing pegs 42 of one block member(s) 105 will snap into the matching divots 43 of an adjacent block member(s) 105. This ensures the alignment both vertically and horizontally with the previous block member(s) 105.

Figure 3:
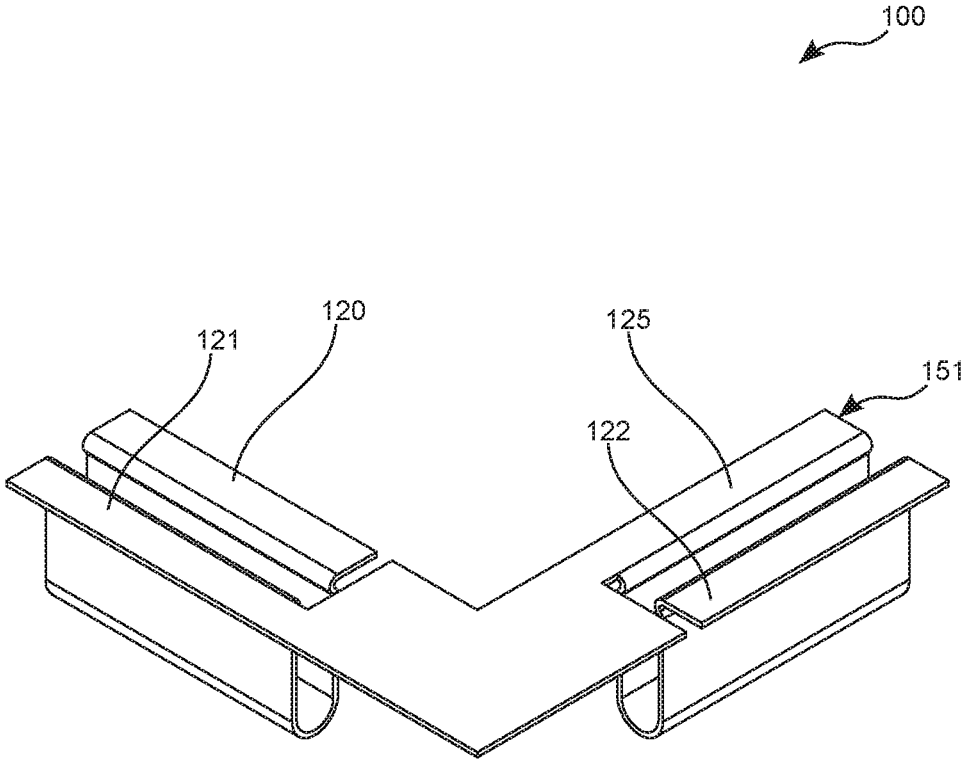
FIG. 3 is a perspective view illustrating an L-shaped securing clip of the modular wall system according to an embodiment of the present invention of FIG. 1.

Referring now to FIG. 3, is a perspective view illustrating L-shaped 151 securing clip 120 of modular wall system 100 according to an embodiment of the present invention of FIG. 1.

A plurality of securing clips 120 each include first elongated side edge 121 including connector member 126 thereon and are adapted to releasably connect with slots 118 of the elongated side edge portions 117 of the four side wall components 110 of any of the plurality of block member(s) 105. Second elongated side edge 125 includes connector member 126 thereon and is adapted to releasably connect with slots 118 of the elongated side edge portions 117 of the four side wall components 110 of any of the plurality of block member(s) 105. Second elongated side edge 125 is spaced from first elongated side edge 121. Securing clips 120 are adapted to releasably connect adjacent the plurality of block member(s) 105. Securing clips 120 for use on corners are formed having L-shape 151 and are adapted to releasably connect with two perpendicularly adjacent side wall components 110.

Figure 4:
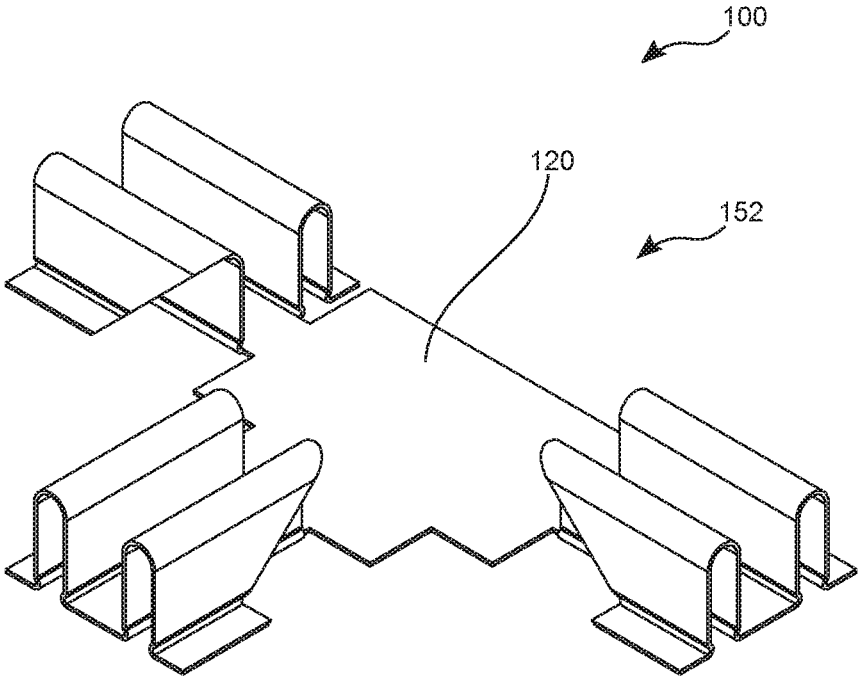
FIG. 4 is a perspective view illustrating a T-shaped securing clip of the modular wall system according to an embodiment of the present invention of FIG. 1.

Referring now to FIG. 4, is a perspective view illustrating T-shaped 152 securing clips 120 of modular wall system 100 according to an embodiment of the present invention of FIG. 1.

Securing clips 120 for use in T-joints or for joining sections are formed having T-shape 152 and are adapted to releasably connect with three adjacent side wall components 110. A plurality of exterior panel members 145 are adapted to releasably connect with respective securing clips 120 such that they can be used to cover a selected portion of modular wall system 100. Each of the four side wall component 110 include opening 113 therethrough adapted to allow cables and conduit to pass through.

Figure 5:
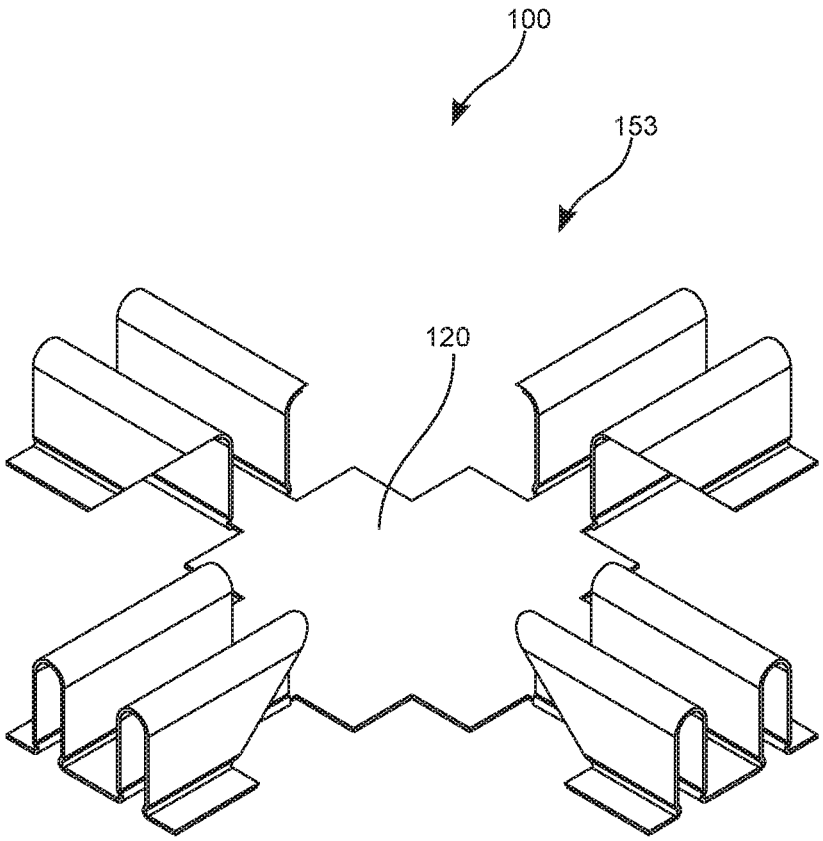
FIG. 5 is a perspective view illustrating an X-shaped securing clip of the modular wall system according to an embodiment of the present invention of FIG. 1.

Referring now to FIG. 5, is a perspective view illustrating X-shaped 153 securing clips 120 of modular wall system 100 according to an embodiment of the present invention of FIG. 1.

Securing clips 120 are formed having X-shaped 153 and is adapted to releasably connect with four adjacent side wall components 110. Each securing clips 120 includes magnetic outer surface 146 thereon and exterior panel members 145 include magnetic edge portions 147 adapted to releasably connect with magnetic outer surface 146 of securing clips 120 such that exterior panel members 145 are adapted to be releasably connected to any one of block member(s) 105.

Figure 6:
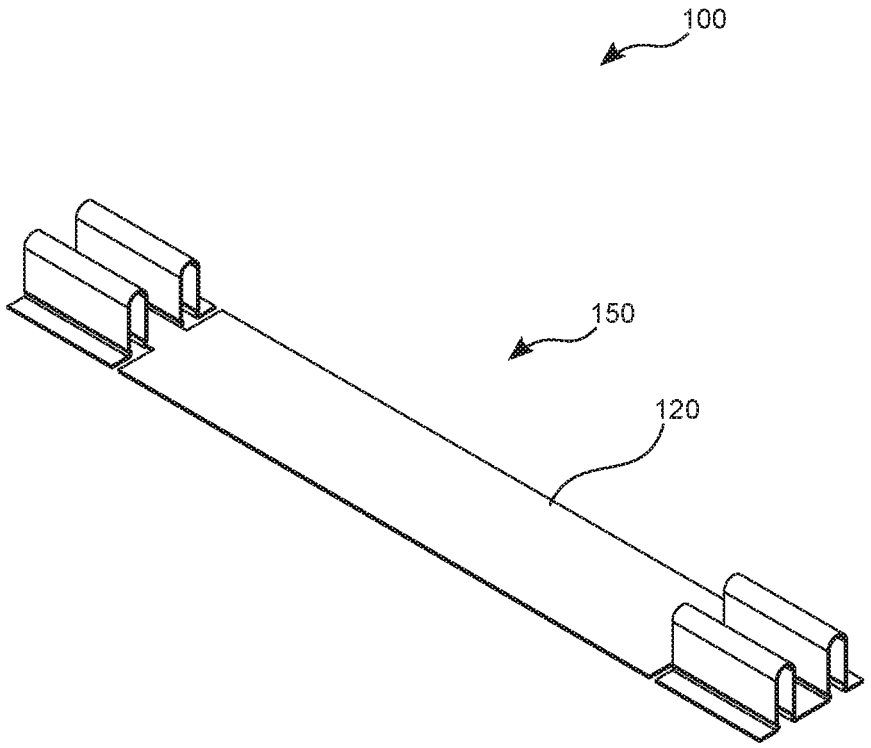
FIG. 6 is a perspective view illustrating a linear shaped securing clip of the modular wall system according to an embodiment of the present invention of FIG. 1.

Referring now to FIG. 6, is a perspective view illustrating linear shaped 150 securing clip 120 of modular wall system 100 according to an embodiment of the present invention of FIG. 1.

Securing clips 120 may be formed having linear shape 150 for some applications and adapted to releasably connect with two linearly adjacent side wall components 110. These clips 120 may typically be used at the top side of modular wall system 100 between two adjacent block member(s) 105 and then exterior panel members 145 cover the exterior of both sides of modular wall system 100. Exterior panel members 145 are preferably formed from a material chosen from a list of materials consisting of plastic and metal.

Figure 7:
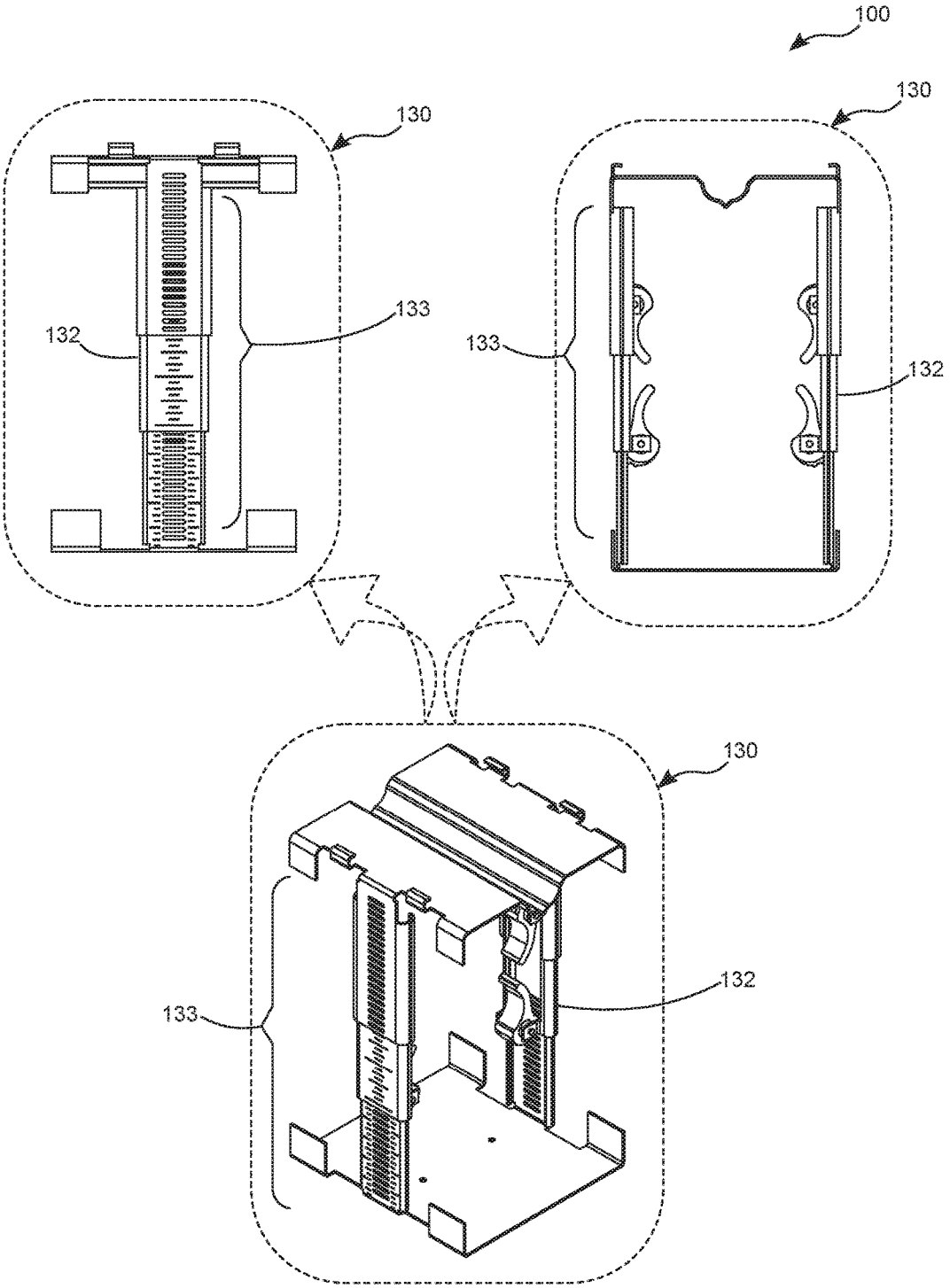
FIG. 7 is a perspective view illustrating a tensioning bracket of the modular wall system according to an embodiment of the present invention of FIG. 1.

Referring now to FIG. 7, is a perspective view illustrating tensioning bracket 130 of modular wall system 100 according to an embodiment of the present invention of FIG. 1.

At least one tensioning bracket 130 that includes at least one connector portion 131 is adapted to releasably connect to the two spaced elongated side edge portions 117 of any one of the four side wall component 110 of any one of the plurality of block member(s) 105. Extension portion 132 having adjustment section 133 includes series of spaced connector members 135 that is adapted to releasably connect with connector portion 131 via series of spaced connector members 135 such that tensioning brackets 130 is/are linearly adjustable. Contact panel 140 is connected to adjustment section 133 and is adapted to contact a wall or ceiling. When in use, tensioning bracket 130 is adapted to act as a support and create space and tension between modular wall system 100 and a wall and ceiling and to stabilize modular wall system 100.

At least two floor base connectors are each adapted to fit within respective openings 113 of side wall component 110 and releasably connect thereto, and are adapted to releasably attach to a floor such that floor base connectors help stabilize modular wall system 100 to the floor. Each of floor base connectors may include a double-sided key adapted to releasably connect with the floor. The floor base connectors may include a bristle type attachment adapted to releasably connect with a carpet upon the floor on quick installations where removing carpet for the construction of a standard wall is undesirable or when the installation is temporary.

Modular wall system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A modular wall system comprising:

a plurality of block members, each including:

four side wall components, each including:

a first surface;

a second surface opposite from said first surface;

two spaced elongated end edge portions;

wherein each said elongated end edge portion includes a hinge portion located thereon; and two spaced elongated side edge portions;

wherein each said elongated side edge portion includes an elongated slot located therein;

wherein said four side wall components are pivotally connected to one another via said hinge portions of respective adjacent said elongated end edge portions thereof and are configured to form a rectangular configuration when in use and a flat configuration when in storage;

wherein said plurality of block members are configured to be stacked on top of one another, and placed side-by-side, to thereby form a modular wall;

a plurality of securing clips, each including:

a first elongated side edge including:

a first connector member located thereon configured to releasably connect with said slots of said elongated side edge portions of said four side wall components of any one or more of said plurality of block members; and a second elongated side edge including:

a second connector member located thereon configured to releasably connect with said slots of said elongated side edge portions of said four side wall components of one or more of said plurality of block members;

wherein said second elongated side edge is spaced from said first elongated side edge;

wherein said a plurality of securing clips are configured to releasably connect adjacent said plurality of block members;

at least one tensioning bracket including:

at least one connector portion;

wherein said at least one connector portion is configured to releasably connect to said two spaced elongated side edge portions of one or more of said four side wall components of any one of said plurality of block members; and an extension portion including:

an adjustment section including:

a series of spaced connector members;

wherein said adjustment section is configured to releasably connect with said connector portion via said series of spaced connector members, such that said at least one tensioning bracket is linearly adjustable; and a contact panel;

wherein said contact panel is connected to said adjustment section and is configured to contact a wall or ceiling member;

wherein said tensioning bracket is configured to act as a support and create space and tension between said modular wall system and a wall and ceiling and to stabilize said modular wall system in the rectangular configuration; and a plurality of exterior panel members;

wherein said plurality of exterior panel members are configured to releasably connect with respective said plurality of securing clips and to cover a selected portion of said modular wall system.

2. The modular wall system of claim 1, wherein said plurality of securing clips are formed having a linear shape to releasably connect with two linearly adjacent said side wall components.

3. The modular wall system of claim 1, wherein said plurality of securing clips are formed having a L-shape to releasably connect with two perpendicularly adjacent said side wall components.

4. The modular wall system of claim 1, wherein said a plurality of securing clips are formed having a T-shape to releasably connect with three adjacent said side wall components.

5. The modular wall system of claim 1, wherein said a plurality of securing clips are formed having a X-shape to releasably connect with four adjacent said side wall components.

6. The modular wall system of claim 1, wherein each of said plurality of securing clips include a magnetic outer surface located thereon; and wherein said plurality of exterior panel members include magnetic edge portions located thereon to releasably connect with said magnetic outer surfaces of said plurality of securing clips, such that said plurality of exterior panel members are configured to be releasably connected to one or more of said plurality of block members.

7. The modular wall system of claim 1, wherein said plurality of block members are formed from a material selected from the group consisting of plastic and metal.

8. The modular wall system of claim 1, wherein said plurality of exterior panel members are formed from a material selected from the group consisting of plastic and metal.

9. The modular wall system of claim 1, wherein said rectangular configuration of said plurality of block members has a square cross-section.

10. The modular wall system of claim 1, wherein each of said four side wall components includes an opening therethrough adapted to allow cables and conduit to pass therethrough.

11. The modular wall system of claim 10, further comprising a plurality of interior plate members each configured to cover said opening of one or more of said side wall components of said plurality of block members.

12. The modular wall system of claim 1, further comprising at least two floor base connectors each configured to fit within respective openings of said side wall components and releasably connect thereto, and are configured to releasably attach to a floor such that said at least two floor base connectors help stabilize said modular wall system with respect to said floor.

13. The modular wall system of claim 12, wherein each of said at least two floor base connectors include a double-sided key configured to releasably connect with said floor.

14. The modular wall system of claim 12, wherein each of said at least two floor base connectors includes a bristle attachment configured to releasably connect with a carpet upon said floor.

* * * * *